US005647404A

United States Patent [19]

Maina et al.

[11] Patent Number: 5,647,404

[45] Date of Patent: Jul. 15, 1997

[54] YARN FEEDER WITH ADJUSTABLE BRAKING DEVICE

[75] Inventors: Bruno Maina, Vigliano Biellese; Roberto Bertolone, Ponzone Biellese, both of Italy

[73] Assignee: Nuova Roj Electrotex S.r.1., Biella, Italy

[21] Appl. No.: 564,185

[22] PCT Filed: Jun. 16, 1994

[86] PCT No.: PCT/EP94/01968

§ 371 Date: Dec. 18, 1995

§ 102(e) Date: Dec. 18, 1995

[87] PCT Pub. No.: WO95/00431

PCT Pub. Date: Jan. 5, 1995

[30] Foreign Application Priority Data

Jun. 17, 1993 [IT] Italy ..... MI93A1313

[51] Int. Cl.[6] ..... B65H 51/22; D03D 47/34

[52] U.S. Cl. ..... 139/452

[58] Field of Search ..... 139/452; 242/47.01

[56] References Cited

U.S. PATENT DOCUMENTS

| | | | |
|---|---|---|---|
| 4,429,723 | 2/1984 | Maroino | 242/47.01 |
| 5,123,455 | 6/1992 | Maina | 139/452 |

FOREIGN PATENT DOCUMENTS

| | | | |
|---|---|---|---|
| 0 049 897 | 4/1982 | European Pat. Off. | 139/452 |
| 0 049 896 | 4/1982 | European Pat. Off. | 139/452 |
| 0 330 951 | 2/1989 | European Pat. Off. | 139/452 |
| 0 534 263 | 3/1993 | European Pat. Off. | 139/452 |
| WO91/14032 | 9/1991 | WIPO | 139/452 |

*Primary Examiner*—Andy Falik

*Attorney, Agent, or Firm*—Young & Thompson

[57] ABSTRACT

Device to feed yarn to machines making use thereof, particularly the weft yarn (T) to gripper or projectile looms, of the type in which the yarn to be feed is unwound from a reserve (R) wound on a drum onto the outlet end of which, where a first yarn deviation takes place, there acts a brake device (FR) which is centered on the drum axis and adjustable along the same, upstream of an outlet yarn guide where a second yarn deviation takes place. The brake device (FR) comprises a frustoconical braking element with continuous surface and differentiated elasticity, carried by a stiff ring support to which it is fixed close to its major circumference, and the stiff ring support is mounted so as to oscillate about two axes (S1, S2) which are perpendicular one in respect of the other and both in respect of the axis of the drum.

2 Claims, 2 Drawing Sheets

YARN FEEDER WITH ADJUSTABLE BRAKING DEVICE

FIELD OF THE INVENTION

The present invention concerns devices to feed yarn to machines making use thereof, and particularly a weft yarn feeder for gripper or projectile loons having improved characteristics.

BACKGROUND OF THE INVENTION

It is well known to feed yarn to machines making use thereof, particularly the weft yarn to looms, by means of feeding devices or yarn feeders. Such devices are positioned between the spool and the loom and are meant to temporarily store the weft yarn. They also facilitate its unwinding from the spool, and subsequently feed it to the loom insertion members with optimal and preset yarn tension values.

The type of structure universally adopted at present for such feeding devices involves winding the yarn into successive turns around a winding unit or drum, kept motionless, by means of a winding arm moved by an electric motor. Means for detecting the amount or reserve of yarn present on the winding drum are provided to control the running and rotation speed of the motor of the feeding device according to the amount of yarn drawn by the loom; so as to make the yarn unwinding speed from the spool as uniform as possible.

When yarn feeders are used on gripper or projectile looms, they comprise at their outlet end yarn braking means, positioned downstream of the yarn winding drum and meant to feed the weft yarn to the loom with a specific desired tension. Many of the known yarn braking devices act directly on the outlet end of the drum and are positioned upstream of an outlet yarn guide of the feeder, meant to ensure a correct unwinding of the weft yarn.

Most yarn feeders make use of brake devices consisting of a plurality of natural or synthetic bristles, fixed to a support in the form of a closed ring carried by a bracket movable along the main axis of the yarn feeder. The plurality of bristles bear—with a variable pressure adapted to be preset by adjusting the axial position of the bracket—onto the outer periphery of the yarn reserve winding drum of the feeder.

Other yarn braking devices have been conceived, as an alternative to the ones with bristles: and their use has proved advantageous to overcome the drawback of the rapid wear of the bristles. The braking element in these devices comprises a plurality of thin sheet-metal strips, positioned side-by-side onto a frustoconical surface and pressing onto the outlet end of the feeder drum. To guarantee—by a self-adjustment of the strips—an efficient and continuous-contact of the strips with the winding drum, the said braking element is preferably mounted onto a cup-shaped support with open bottom, carried by a bracket of the yarn feeder the position of which is adjustable along the drum axis. A yarn braking device with sheet-metal strips of this type, which has proved satisfactory and has found a widespread use, is disclosed in EP-B1-49897 filed by the same Applicant. In this brake device, the sheet-metal strips are in the form of thin blades and the cup-shaped support is mounted on the movable bracket of the yarn feeder by way of a double articulation, so as to be able to perform limited oscillations about two axes perpendicular to each other and to the axis of the feeder drum.

More recently, brake devices for yarn feeders having still different characteristics have been conceived. These devices comprise a continuous braking band carried by a plurality of tongues with varying flexibility. The tongues are self-adjustable in that they are mounted movable into a fixed support. Examples of such brake devices are described in PCT/EP93/03086 and PCT/EP93/03262, both filed by the same Applicant. Due to the particular configuration of these devices and, above all, to their mounting—which allows the braking element to be widely deformed and to perform short movements in every direction in the support (thus acting like a universal joint, adapted to guarantee all degrees of freedom)—a perfect adjustment of the braking element in respect of the drum is obtained in the tangent area of contact, particularly taking into account the deformations caused by the passage of the weft yarn, and this allows to guarantee a very regular yarn tension diagram.

Even further improvements in the behavior of the brake device, in its area of contact with the feeder drum—allowing to simultaneously obtain a yarn tension trend, during weft insertion, with no harmful peaks (so as to ensure a good result in the weft insertion process)—have been accomplished with the yarn braking device proposed by the Applicant in PCT/EP94/00476. In this case the device, centered on the drum axis and adjustable along the same, comprises a frustoconical braking element with continuous surface and varying flexibility, carried by a stiff ring supported to which it is fixed close to its major circumference. The support is in turn fixedly mounted onto a bracket of the yarn feeder, the position of which is adjustable along the drum axis. Similar brake devices—wherein the braking element consists of a continuous surface supported by a highly flexible member, such as to allow a self-adjustment of the continuous surface in respect of the outlet end of the winding drum—are described in EP-A1-534263 in the name of L.G.L. Electronics.

From a careful consideration of the techniques described heretofore and their developments, it can be noticed that brake devices for yarn feeders have evolved towards the use of a braking element with continuous surface, which seems to be more suited than others to solve the more and more complicated problems faced by the experts as a result of the advanced state of technique in this field and its constant profess.

It can be noticed moreover that the already known types of brake devices for yarn feeders: including the most evolved ones, while allowing to obtain a satisfactory braking effect for weft yarn insertion purposes, are not adapted to conveniently solve the problem of the proper adjustment of the braking element in respect of the outlet end of the winding drum, when—as it happens fairly often, for various reasons, in the industrial production process—in the brake devices which are introduced on the market (either new, or after a more or less long period of use): the braking element is not perfectly aligned with the winding unit of the yarn feeder.

SUMMARY OF THE INVENTION

The object of the present invention is to supply a yarn feeder, wherein the brake device—while providing the advantageous characteristics resulting from the use of the latest types of braking elements (particularly, a frustoconical braking element with continuous surface, carried by a stiff ring support centered on the drum axis and adjustable along the same)—can be more easily adapted to any of the possible aforementioned misalignments, so as to allow, on one hand, to make the best use of yarn feeders produced with high precision and, on the other hand, to be able to produce yarn feeders having less characteristics of precision, with the certainty that they can equally be used for a very long time, with acceptable performances.

For this purpose, the present invention provides a device to feed the yarn to machines making use thereof, particularly the weft yarn to gripper or projectile looms, of the type in which the yarn to be fed is unwound from a reserve wound on a drum, onto the outlet end of which—where a first yarn deviation takes place—there acts a brake device, which is centered on the drum axis and adjustable along the same, upstream of an outlet yarn guide—where a second yarn deviation takes place—characterized in that, the brake device comprises a frustoconical braking element with continuous surface and varying elasticity, carried by a stiff ring support to which it is fixed close to its major circumference, and in that, the stiff ring support is mounted so as to oscillate about two axes, which are perpendicular one in respect of the other and both in respect of the drum axis.

A brake device according to the present invention, thanks to the characteristic combination of the particular structure and shape of the braking element, with its mounting system comprising a double articulation allows a prompt and easy adjustment of the braking surface of the element to the best conditions of tangency in respect of the end portion of the winding unit, even if the winding Unit and the brake device are not perfectly coaxial. The brake device is therefore adapted to solve any problems due to a geometrically imperfect construction and/or mounting of the yarn feeder.

According to a preferred embodiment, the stiff ring support is hinged at the ends of a fork pivoted to a slide, the position of which cap be adjusted along the drum axis.

The invention will now be described in further detail, by mere way of example, with reference to a preferred embodiment thereof, illustrated on the accompanying drawings, in which:

FIG. 1 is a side view, with some cutaway parts, of the improved yarn feeder according to the invention;

FIG. 2 is a detailed front view of the brake device mounted on the yarn feeder shown in FIG. 1, from which some parts have been removed; and FIG. 3 is a diagrammatic view of a detail of the brake device shown in FIG. 2.

Figure 1:
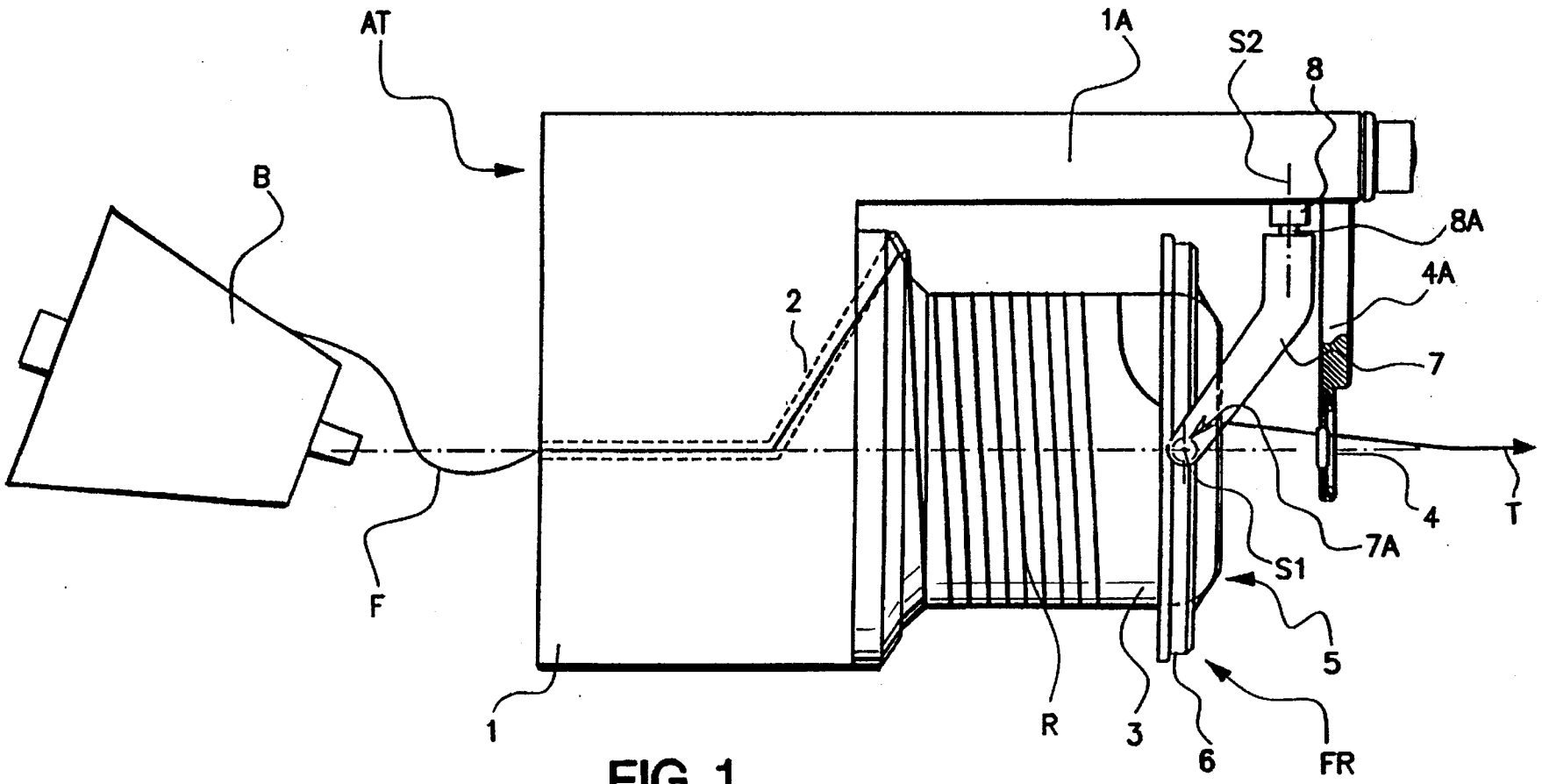
As shown in FIG. 1, the yarn feeder AT according to the invention receives in known manner the yarn F from a reel B or spool and feeds said yarn as weft T to a stripper or projectile loom (not shown).

Also in known manner, in the yarn feeder AT which comprises a body 1 with an arm 1A projecting there from a reserve R of yarn F is wound into successive turns, by a winding element 2, around a drum 3 kept motionless and the axis of which is parallel to the arm 1A.

The weft yarn T is fed to the loom by being unwound along the drum axis from the reserve R, guided by an outlet yarn guide 4, after having been braked in correspondence of the outlet end of the drum 3.

The yarn guide 4 is carried—downstream of the drum 3 and centered along its axis—by a bracket 4A: the position of which is adjustable along the upper arm 1A of the yarn feeder AT.

In the aforedescribed yarn feeder, the braking of the weft yarn T at the outlet end of the drum 3 is obtained by means of a brake device FR comprising a braking element 5, which consists of an annular elastic membrane extending over a frustoconical surface and being fixed, with its outer edge of wider diameter: to a stiff ring 6. According to the invention, the stiff ring 6 is carried by the arm 1A of the yarn feeder AT with a double articulation system comprising a fork 7, onto the ends of which the ring 6 is pivoted in 7A, and a slide 8 on which the fork 7 is pivoted in 8A. The slide being movable along the arm 1A to allow regulating the contact pressure of the braking element 5 onto the outlet end of the drum 3.

Figure 2:
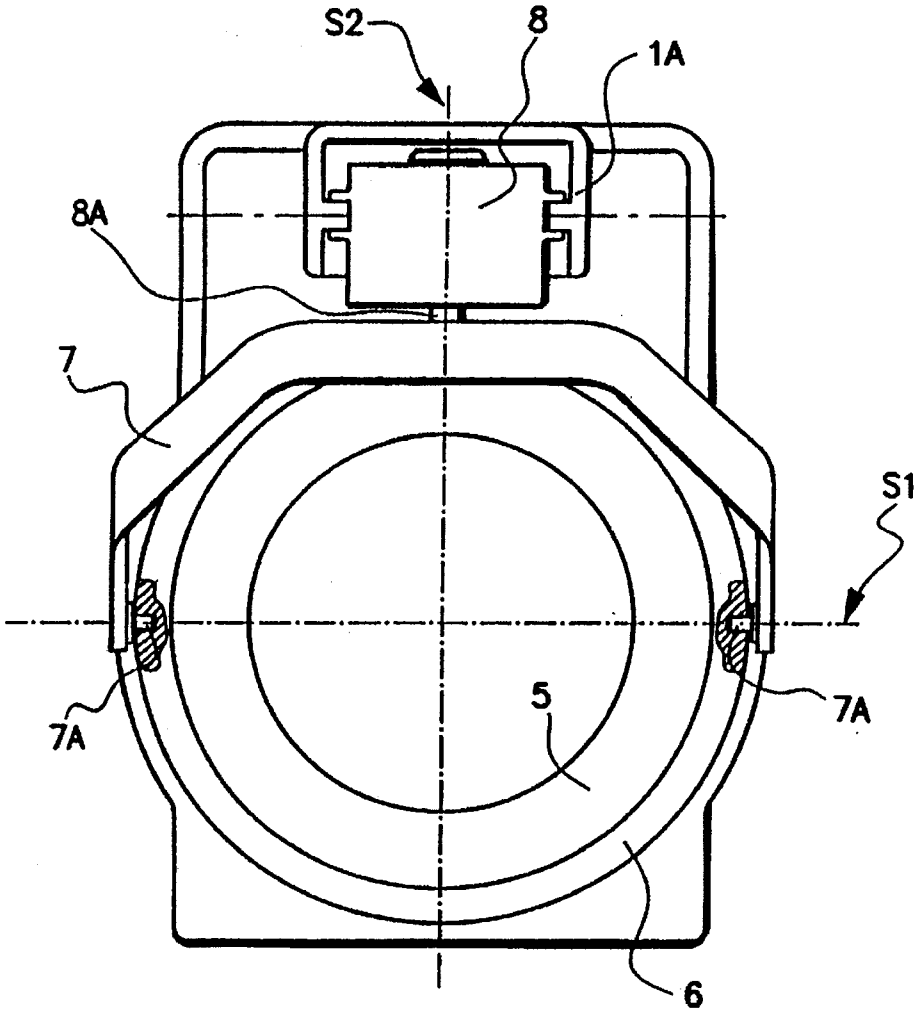

As shown more clearly in FIG. 2, which is a front view of the yarn feeder without the bracket 4A and yarn guide 4 the fork 7 engages the ring 6 in correspondence of two hingeing points 7A positioned along a horizontal axis S1, while the fork 7 is in turn mounted on the slide 8 by way of the hinge 8A positioned on the vertical axis S2. The axes S1 and S2 are thus perpendicular one in respect of the other and they are both perpendicular to the axis of the yarn feeder.

The mounting system with double articulation enables the stiff ring 6, supporting the braking element 5, to perform oscillating movements about two axes S1 and S2, so as to allow the braking element which has a frustoconical surface, to take up the most correct tangent position in respect of the outlet end portion of the drum 3, normally just in correspondence of the point of contact with the drum having a pseudo-toroidal surface.

Figure 3:
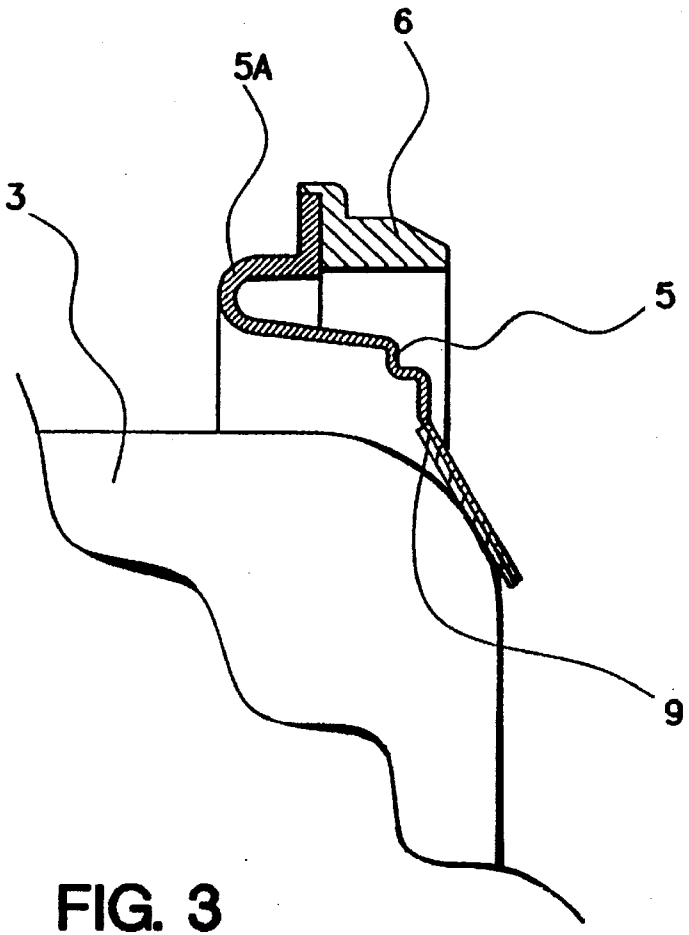

FIG. 3 shows in detail a section of the brake device FR according to a preferred embodiment thereof. The device consists of a stiff ring 6 and of a substantially frustoconical braking element 5 fixed thereto. The braking element 5 is formed by a continuous elastic membrane, preferably with varying elasticity, mainly thanks to the presence of a bent end portion 5A close to the stiff ring 6, comprising, on the inner surface of its other free end portion, a wearproof metal element 9, which is also formed with a strictly continuous frustoconical surface and which extends tangentially to the outlet end portion of the drum 3.

We claim:

1. Device for feeding weft yarn to gripper or projectile looms, comprising a drum for storing a weft yarn reserve wound on the drum, said drum having an axis and an outlet end, said weft yarn being unwound from said weft yarn reserve onto said outlet end where a first yard deviation takes place, a yarn brake device acting on said outlet end, said yarn brake device being positioned upstream of an outlet yarn guide where a second yarn deviation takes place, said yarn brake device being centered on the drum axis and adjustable along said axis, said yarn brake device comprising a frustoconical braking element having a major circumference and a minor circumference, and a continuous surface of varying elasticity, said braking element being fixed to a stiff ring support close to said major circumference, and said stiff ring support being mounted so as to oscillate about two axes, which are perpendicular one in respect of the other, and both in respect of the axis of the drum.

2. Device according to claim 1, wherein said stiff ring support is hinged at ends of a fork pivoted to a slide, the position of said slide adapted to be adjustable along the axis of the drum.

* * * * *